US007422049B2

(12) United States Patent
Roehrig et al.

(10) Patent No.: US 7,422,049 B2
(45) Date of Patent: Sep. 9, 2008

(54) TUBULAR MOULD FOR CONTINUOUS CASTING

(75) Inventors: Adalbert Roehrig, Thalwil (CH); Franz Kawa, Adliswil (CH)

(73) Assignee: Concast AG, Zurich (CH)

( * ) Notice: Subject to any disclaimer, the term of this patent is extended or adjusted under 35 U.S.C. 154(b) by 0 days.

(21) Appl. No.: 10/550,373

(22) PCT Filed: Apr. 7, 2004

(86) PCT No.: PCT/EP2004/003712

§ 371 (c)(1),
(2), (4) Date: Jun. 28, 2006

(87) PCT Pub. No.: WO2004/091826

PCT Pub. Date: Oct. 28, 2004

(65) Prior Publication Data

US 2006/0237161 A1 Oct. 26, 2006

(30) Foreign Application Priority Data

Apr. 16, 2003 (EP) ..... 03008681

(51) Int. Cl.
*B22D 11/055* (2006.01)

(52) U.S. Cl. ..... 164/443; 164/418

(58) Field of Classification Search ..... 164/418, 164/459, 485, 443, 348
See application file for complete search history.

(56) References Cited

U.S. PATENT DOCUMENTS

| | | | | |
|---|---|---|---|---|
| 3,667,534 | A * | 6/1972 | Kanokogi et al. | 164/478 |
| 3,730,257 | A * | 5/1973 | Haussner | 164/443 |
| 4,078,600 | A | 3/1978 | Cashdollar | |
| 4,167,211 | A * | 9/1979 | Haller | 165/78 |
| 4,299,267 | A * | 11/1981 | Birat et al. | 164/502 |
| 4,949,773 | A * | 8/1990 | Nomura et al. | 164/91 |
| 6,374,903 | B1 * | 4/2002 | Sears, Jr. | 164/485 |

FOREIGN PATENT DOCUMENTS

EP 0 268 143 A2 5/1988

* cited by examiner

*Primary Examiner*—Kuang Lin
(74) *Attorney, Agent, or Firm*—Darby & Darby

(57) ABSTRACT

In the continuous casting of round or polygonal billet and bloom formats, use is made of moulds the mould cavity of which comprises a copper tube (3) which is intensively cooled by means of water-circulation cooling. In order to increase the cooling capacity on the one hand and the dimensional stability of the mould cavity (4) on the other hand, and also extend the total service life of the copper tube (3), it is proposed to provide the copper tube (3) with a supporting shell (12) or supporting plates over the entire circumference at the tube outer lateral surface (5). For the cooling of the copper tube (3), cooling ducts (6) for guiding the cooling water are arranged on the copper tube (3) or on the supporting shell (12). The cooling ducts (6) are distributed over the entire circumference at the tube outer lateral surface (5) and extend substantially over the entire mould length.

19 Claims, 3 Drawing Sheets

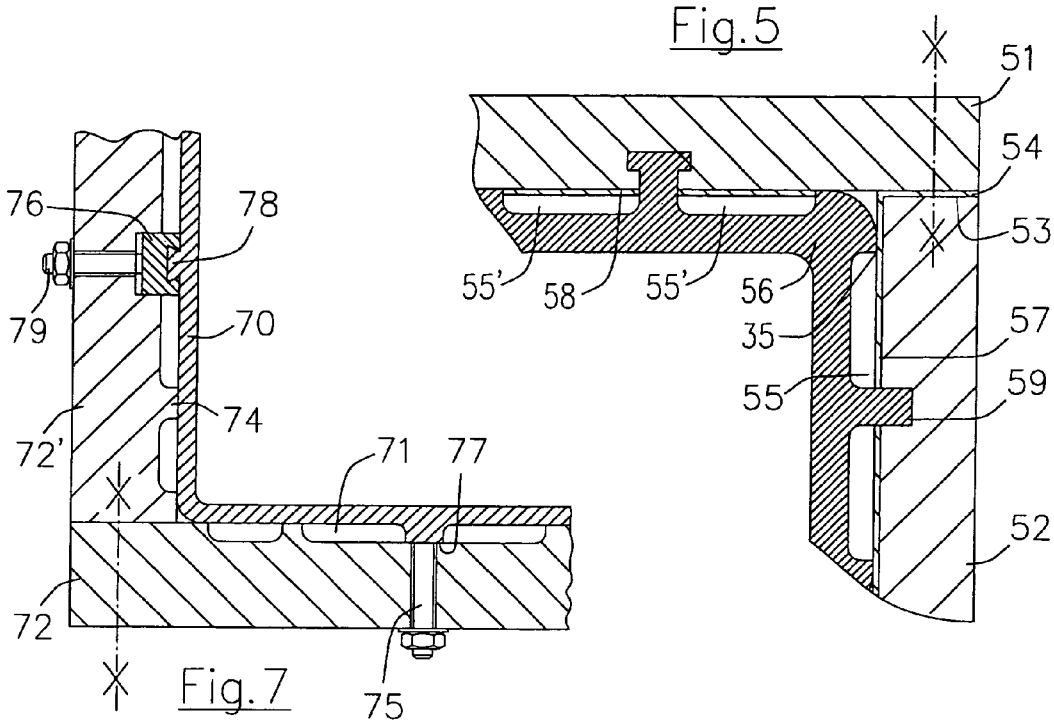
Fig.5
51
54
53
55'
58
55'
56
35
57
55
59
52
76
78
79
70
74
72'
71
77
72
75
Fig.7
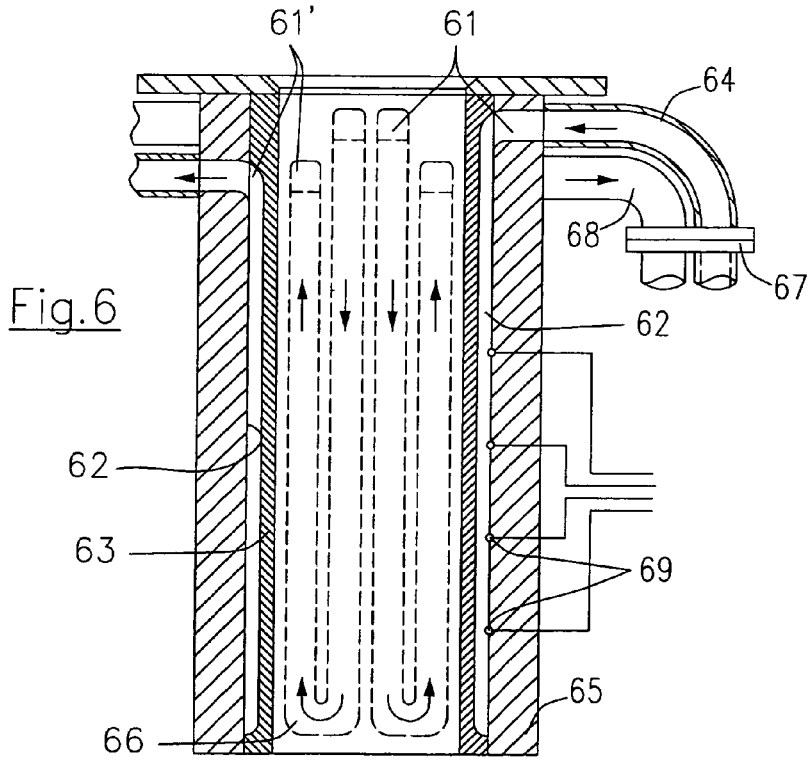
61'
61
64
68
67
Fig.6
62
62
63
69
65
66

TUBULAR MOULD FOR CONTINUOUS CASTING

CROSS REFERENCE TO PRIOR APPLICATION

This is a U.S. national phase application under 35 U.S.C. §371 of International Patent Application No. PCT/EP2004/003712, filed Apr. 7, 2004, and claims benefit of European Patent Application No. 03008681.3, filed Apr. 16, 2003, which is incorporated by reference herein. The International Application was published in German on Oct. 28, 2004 as WO 2004/091826 A1 under PCT Article 21(2).

BACKGROUND OF THE INVENTION

1. Field of the Invention

The invention relates to a tubular mould for the continuous casting of round and polygonal billet and bloom cross-sections according to the precharacterising clause of claim 1 or 2.

2. Description of Related Art

In the continuous casting of steel in billet and small bloom cross-sections, tubular moulds are used. Such tubular moulds comprise a copper tube fitted into a water jacket. In order to achieve circulation cooling with a high flow rate of the cooling water, a tubular displacer is arranged outside the copper tube with a small gap relative to the copper tube. The cooling water is forced through between the displacer and the copper tube over the entire circumference of the copper tube at a high pressure and high flow rate of up to 10 m/s and above. To prevent any damaging deformations of the copper tube during casting operation due to the high temperature differences between the mould cavity side and the cooling water side, the copper tubes, which are essentially held only at the lower and upper tube end by flanges, must have a minimum wall thickness. This minimum wall thickness is dependent on the casting format and is between 8 and 15 mm.

Since the beginning of industrial continuous casting, efforts have been made by those skilled in the art to increase the casting speed in order to achieve higher outputs per strand. The increase of the casting capacity is closely related to the cooling capacity of the mould. The cooling capacity of a mould wall or of the entire mould cavity is influenced by many factors. Important factors are the thermal conductivity of the copper tube, the wall thickness of the mould wall, the dimensional stability of the mould cavity in order to avoid distortion or air gaps between the strand skin and the mould wall, etc.

However, besides the cooling capacity, which may exert a direct influence on the output per strand for a given strand format, the service life of the mould also constitutes an important cost factor for the economic efficiency of the continuous casting plant. The service life of a mould expresses how many tonnes of steel can be cast into a mould before wear phenomena in the mould cavity, such as abrasive wear, material damage, in particular hot cracks, or damaging deformations of the mould cavity, necessitate a change of mould. Depending on the state of wear, the mould tube has to be scrapped or undergo refinishing so that it can be used again. In the case of standard conical moulds, moulds with somewhat greater copper tube wall thicknesses have higher dimensional stabilities.

SUMMARY OF THE INVENTION

The object of the invention is to provide a continuous casting mould for billet and bloom formats which affords, in particular, a higher cooling capacity and hence allows higher casting speeds, without reaching the limits of thermal loadability of the copper material. Furthermore, this mould is to have a higher dimensional stability during casting operation and hence produce less abrasive wear as the strand skin passes through the mould on the one hand and a more uniform cooling or better strand quality on the other hand. In particular, formation of diamond-shaped strand cross-sections is to be avoided. In addition, the mould is to achieve an extended total service life and hence reduce the mould costs per tonne of steel.

This object is achieved according to the invention by the characterising features of claim 1 or 2.

The following advantages can be obtained on continuous casting with the tubular mould according to the invention. The lower wall thickness of the copper tube compared with the prior art ensures a higher cooling capacity with a corresponding increase in the output of the continuous casting plant. The supporting plates arranged substantially over the entire circumference stabilise the geometry of the mould cavity against distortion of the thermally loaded copper walls of the mould tube, so that on the one hand the mould wear is reduced and on the other hand the strand quality is improved, as a result in particular of a more uniform cooling. An extended service life is obtained through reduced thermal loading of the copper material and lower abrasive wear between the strand skin and the mould walls. The total service life is however also extended through refinishing operations in the mould cavity, such as re-copperplating of worn spots with subsequent remachining etc., the copper tube remaining connected to the supporting shell or to the supporting plates during these operations. In the case of machining, this facilitates the clamping, and when milling or planing etc. vibrations of the copper tube are prevented by the supporting plates, thereby allowing higher machining speeds together with a high dimensional accuracy of the mould cavity. The fact that the supporting plates remain on the copper tube during the reconditioning of the copper tube also reduces, however, the work required to demount the water-circulation cooling arrangement of the mould, thereby reducing reconditioning costs.

The cooling ducts can be partially let into or milled into the supporting plates and into the outer lateral surface of the copper tube. To increase the contact area between the copper tube and cooling medium, it is advantageous for the cooling ducts to reduce the wall thickness of the copper tube in the region of the cooling ducts by about 30-50%.

If the cooling ducts at the tube lateral surface are milled into the copper tube, supporting and connecting ribs can be arranged between the cooling ducts without significantly reducing the cooling capacity. According to an exemplary embodiment, it is proposed that the cooling ducts take up 65%-95%, preferably 70%-80%, of the outer surface of the copper tube. Depending on the cross-section of the mould cavity, the residual wall thickness of the copper tube in the region of the cooling ducts is set at about 4 mm to 10 mm. By a suitable choice of the cooling-duct geometry and/or cooling-duct coating, the heat transmission to the cooling water can be set in accordance with the local requirements.

In the case of rectangular strand formats, four supporting plates are releasably or fixedly attached to the copper tube. In order to ensure that the supporting plates bear against the copper tube in a manner free from play irrespective of the manufacturing tolerances, according to an exemplary embodiment the supporting plates can on the one hand butt at their end face against and on the other hand overlap their neighbouring plates. Neighbouring supporting plates are screwed together in the corner regions of the copper tube and thus form a supporting box arranged around the copper tube.

Depending on the design used for clamping the copper tube, the supporting plates can clamp the copper tube without play and rigidly, or in the case of polygonal formats small gaps for seals, preferably elastic seals, can be provided between the individual supporting plates at the overlaps. Such small gaps can take up thermal expansion of the copper tube walls and/or dimensional tolerances of the copper tube lateral surface.

Depending on the extent of the thermal and mechanical loading of the inner wall of the mould cavity by liquid steel or a thin strand skin, or by a predetermined strand skin deformation inside the mould cavity, supporting and connecting ribs which support the copper tube on the supporting plates or on the supporting shell and/or connect it thereto are to be arranged accordingly.

According to an exemplary embodiment, at the lateral surface of the copper tube, for each side of the strand, narrow supporting surfaces are arranged along the corner regions and depending on the format one or two connecting ribs are arranged in the middle region of the strand sides, the connecting ribs being provided with securing devices to prevent movements transversely to the strand axis. Such securing devices can comprise, for example, a dovetail profile, a T-profile for sliding blocks or generally a positive or non-positive securing device. As the supporting plates are advantageously not removed during a reconditioning of the mould cavity, soldered and adhesively-bonded joints can also be employed.

In the case of moulds with a curved mould cavity, the two supporting plates which support the curved side walls of the mould are advantageously provided with plane outer sides, to enable the mould to be clamped without distortion onto a table of a finishing machine during the refinishing.

A suitable material for the supporting plates is, for example, commercial quality steel, provided that the mould is not equipped with an electromagnetic stirring device. The compact construction of the copper tube with its supporting plates and cooling ducts lying therebetween facilitates the use of electromagnetic stirring devices. Further advantages of electromagnetic stirring devices can be obtained through the choice of material of the supporting plates. According to an exemplary embodiment, the supporting plates or the supporting shell can be fabricated from a metallic material (austenitic steel etc.) or non-metallic material (plastic etc.) which can be easily penetrated by a magnetic field. Composite materials may also be included in the choice of materials.

According to a further exemplary embodiment, it is proposed to arrange electromagnetic coils outside the supporting plates or the supporting shell, or to fit movable permanent magnets into the supporting plates or the supporting shell.

If the supporting plates are produced from a metallic material, it is advantageous to prevent the electrolytic corrosion due the cooling water by a protective layer arranged between the supporting plates and the copper tube. Such a protective layer can be constructed, for example, by a copperplating of the supporting plate. It is however also possible to close off the cooling ducts let into the copper tube with a copper layer produced by electrodeposition.

The cooling ducts in the copper tube are connected to water supply and discharge lines at the supporting plates or at the supporting shell. According to an exemplary embodiment, it is advantageous for the water supply and discharge lines to be arranged alongside each other on the supporting plates at the upper end of the mould and to be connectable to the cooling-water system by means of a quick coupling.

BRIEF DESCRIPTION OF THE DRAWINGS

Exemplary embodiments of the invention are explained below with reference to figures, in which:

FIG. 5 shows a partial horizontal section through a mould corner, FIG. 6 shows a vertical section through a further example of a mould, and FIG. 7 shows a partial horizontal section through a mould corner of a further exemplary embodiment.

DETAILED DESCRIPTION OF THE EMBODIMENTS OF THE INVENTION

Figure 1:
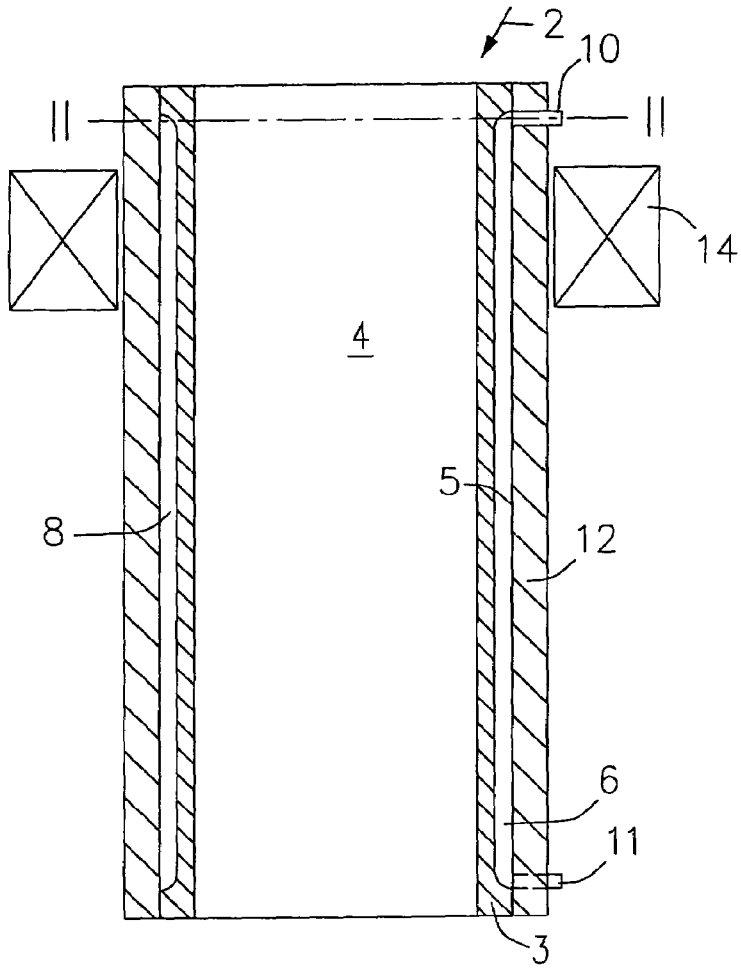
FIG. 1 shows a longitudinal section through a mould according to the invention for round strands.
Figure 2:
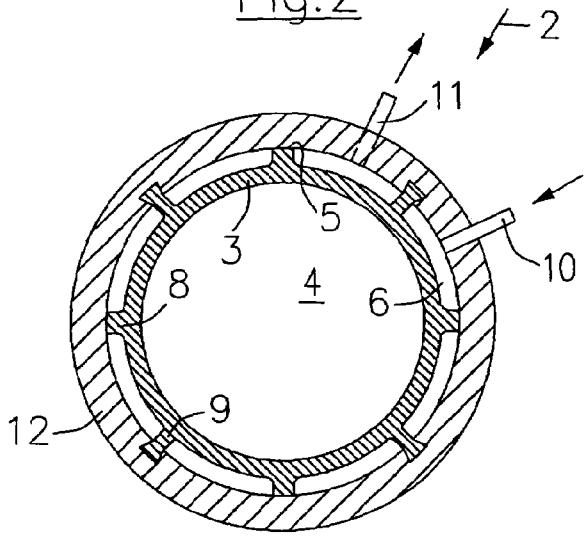
FIG. 2 shows a horizontal section along the line II-II in FIG. 1.

In FIGS. 1 and 2, a continuous casting mould for round billet or bloom strands is depicted by 2. A copper tube 3 forms a mould cavity 4. Provided at the outer side of the copper tube 3, which side forms the tube outer lateral surface 5, is water-circulation cooling for the copper tube 3. This water-circulation cooling comprises cooling ducts 6 distributed over the entire circumference and substantially over the entire length of the copper tube 3. The individual cooling ducts 6 are delimited by supporting and connecting ribs 8 and 9, respectively, an additional task of which is to guide the cooling-water circulation into the cooling ducts 6 from a water supply line 10 to a water discharge line 11. 12 depicts a supporting shell which surrounds the copper tube 3 over the entire circumference and over the entire length and supports the copper tube 3 at the tube outer lateral surface 5 via the supporting ribs 8. The connecting ribs 9 connect the copper tube 3 to the supporting shell 12. The supporting shell 12 forms with its inner lateral surface the outer boundary of the cooling ducts 6.

The cooling ducts 6 are let into the outer lateral surface of the copper tube 3 and thereby reduce the wall thickness of the copper tube 3 by 20%-70%, preferably by 30%-50%, compared with the copper-tube thickness at the supporting ribs 8. The thinner the wall thickness of the copper tube 3 in the region of the cooling ducts 6 can be made, the greater the heat transmission from the strand to the cooling water becomes, while at the same time the operating temperature of the copper wall during the casting is also reduced. Lower operating temperatures in the copper wall not only reduce the distortion of the mould tube 3 but also the wear, such as for example cracks in the bath surface region or abrasive wear in the lower mould region.

14 in FIG. 1 schematically depicts a stirring coil for stirring the liquid crater during the continuous casting in the mould. It is clearly evident that, through the compact construction of the mould and with its reduced copper wall thickness, the stirring coil 14 is very closely adjacent to the mould cavity 4 and hence magnetic field losses are reduced compared with conventional moulds. In magnetic field applications, supporting plates or the supporting shell 12 are produced from a metallic material which can be easily penetrated by magnetic fields, preferably from stainless austenitic steel. It is however also possible to produce the supporting shell 12 or supporting plates from non-metallic materials, for example from carbon laminate etc.

Figure 3:
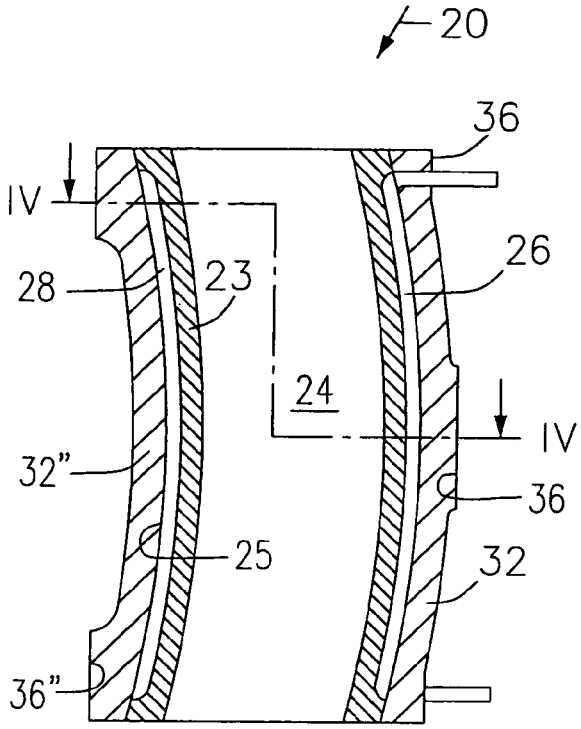
FIG. 3 shows a longitudinal section through a curved mould for a square billet cross-section.
Figure 4:
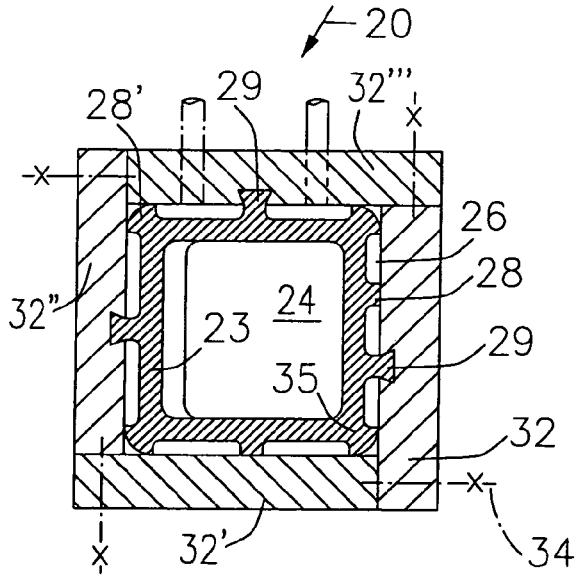
FIG. 4 shows a horizontal section along the line IV-IV in FIG. 3.

In FIGS. 3 and 4, a mould for square or polygonal billet and bloom strands is depicted by 20. A curved copper tube 23 forms a curved mould cavity 24 for a circular arc-type continuous casting machine. Water-circulation cooling is provided between the copper tube 23 and supporting plates 32-32'''. Supporting and connecting ribs 28 and 29, respectively, are provided in cooling ducts 26. The water-circulation cooling is essentially designed the same as that described in FIGS. 1 and 2. Instead of the tubular supporting shell 12 in FIGS. 1 and 2, the copper tube 23 in FIGS. 3 and 4 is clamped between four supporting plates 32-32''' which form a supporting box. The supporting plates 32-32''' are connected to the copper tube 23 via the connecting ribs 29, and the outer lateral surface 25 of the copper tube 23 can be supported on the supporting plates 32-32''' at supporting ribs 28. The four supporting plates 32-32''' are screwed together, to form a rigid box around the copper tube 23, in such a way that each supporting plate 32-32''' butts at its end face against one neighbouring plate and overlaps the other neighbouring plate. Symbols 34 indicate screws or other connecting elements. The supporting plates 32-32''' can be releasably connected to the copper tube 23 by, for example, dovetail or sliding-block guides, clamping screws, threaded bolts etc. It is however also possible to connect the copper tube 23 to the supporting plates 32 or the supporting shell 12 (FIGS. 1+2) by soldered or adhesively bonded joints etc., since for refinishing of the copper tube 23, such as electrolytic re-copperplating and subsequent machining, the copper tube 23 remains connected to the supporting plates 32 or the supporting shell 12.

At four corner regions 35 with supporting ribs 28', the copper tube 23 is clamped or supported on the box of the supporting plates 32-32'''. The copper tube 23 is generally produced by cold drawing and has in the corner regions and at the supporting ribs 28, 28' the wall thickness resulting from the production process. This wall thickness is essentially dependent on the strand format to be cast and is generally 11 mm for a strand format of 120×120 $mm^2$ and 16 mm for 200×200 $mm^2$. The cooling ducts 6, 26 are made, by milling, in such a way that a predetermined water circulation between a cooling-water inlet opening and a cooling-water outlet opening is ensured. In the region of the cooling ducts, the copper tube 23 has a residual wall thickness of 4-10 mm. The cooling ducts 6, 26 take up an area of 65%-95%, preferably 70%-80%, of the outer surface (tube lateral surface 25) of the copper tube 23. The narrow supporting surfaces 28' on both sides of the four tube corners contribute considerably to maintaining the geometry of the mould cavity. They ensure that the four angles of the copper tube 23 do not become distorted during the casting operation. The risk of producing diamond-shaped strands is thereby partially eliminated.

Between the corner regions there are provided connecting ribs 29 which connect the copper tube 23 to the supporting plates 32-32''' via securing devices. They ensure that bending of the copper tube walls towards the mould cavity 24 or lateral displacement transversely to the strand running direction can be avoided. Known positive and non-positive connections are possible as the securing devices, such as for example dovetail profiles or T-profiles for sliding blocks, welded-on bolts etc.

In the case of curved moulds, it is advantageous for the two supporting plates 32, 32" which support the curved side walls of the copper tube 23 to have plane boundary surfaces 36, 36" at their sides opposite the curved supporting surfaces.

In FIG. 5, a supporting plate 51 overlaps a supporting plate 52, which butts at its end face 53 against the supporting plate 51. Arranged between the two plates 51, 52 is an elastic seal 54 which, besides the sealing function to prevent cooling water from escaping, can take up small tolerances in the external dimensions of the copper tube, but also small expansions of the copper tube wall transversely to the strand withdrawal direction.

In order to eliminate electrolytic corrosion between the cooling ducts 55 of the copper mould 56 and the supporting plates 51, 52, the supporting plates 51, 52 can be covered with a protective layer 57 of copper or an electrically non-conducting layer. As an alternative to a protective layer 57, the cooling ducts 55' for example can be closed off, after being milled into the copper wall, with an electrodeposited copper layer 58.

59 in FIG. 5 depicts a connecting rib which is fixedly connected to the supporting plate by soldering or adhesive bonding.

In FIG. 6, an example of water-circulation cooling in cooling ducts 61, 61' along an outer lateral surface 62 of a copper tube 63 is depicted. Cooling water is supplied to the cooling ducts 61 through a pipe system 64 outside supporting plates 65. In the lower part 66 of the mould, the cooling water is deflected by 180° and led to the cooling ducts 61'. The cooling water is discharged from the mould via a pipe system 68. 67 schematically depicts a coupling plate which couples or uncouples the pipe systems 64, 68 to or from a water supply when the mould is set down on a mould table (not depicted).

As examples of further measuring points 69, temperature sensors fitted in the outer lateral surface 62 of the copper tube 63 are indicated, these sensors measuring the temperatures at various locations on the copper tube 63 during the casting operation. Such measurements can be used to graphically represent a temperature profile of the entire copper tube 63 on a screen.

The cooling ducts 61', which are let into the copper wall and which return the cooling water and lead it to the pipe system 68, can also be run as closed return ducts in the supporting plates 65. In such an arrangement, the heating of the cooling water and the copper wall temperatures can be further reduced.

The cooling ducts in FIGS. 1-6 can be let into the copper tube by various production processes. It is possible to mill the cooling ducts into the outer or inner lateral surface of the copper tube and subsequently close them off with an electrodeposited layer. To further increase the wear resistance in the mould cavity, hard chromium plating, which is known in the prior art, can be provided in the mould cavity.

In FIG. 7, cooling ducts 71 are arranged in supporting plates 72, 72'. A copper tube 70 is chosen which is very thin in terms of its wall thickness, for example 3 mm-8 mm. Accordingly, such thin copper tubes 70 are frequently supported by supporting surfaces 74 formed on the supporting plates 72, 72'. Fastening surfaces 77 or connecting profiles 78 are generally provided on the copper tube 70. The copper tube 70 is releasably or fixedly connected to the supporting plates 72, 72' by fastening devices, such as for example a connecting bolt 75 or a dovetail-profile plate 76 with one or more tie rods 79.

The invention claimed is:

1. Mold for the continuous casting of round billet and bloom formats, comprising a copper tube, which forms a mold cavity, and an arrangement for cooling the copper tube by water-circulation cooling, wherein the copper tube is provided over its entire circumference and substantially over its entire length with a supporting shell which supports the copper tube at its outer lateral surface at supporting surfaces thereof, the supporting surfaces comprising at least supporting ribs and connecting ribs provided with securing devices to prevent transverse movements of the copper tube, and further comprising cooling ducts delimited by the supporting ribs and the connecting ribs arranged for guiding the water distributed over the entire circumference and substantially over the entire mold length in one of the copper tube and the supporting shell, wherein said supporting shell comprises grooves for receiving said connecting ribs.

2. Mold according to claim 1, wherein the cooling ducts reduce wall thickness of the copper tube where the cooling ducts are located by an amount selected from the group consisting of 20% to 70% and 30% to 50%.

3. Mold according to claim 1, wherein the cooling ducts occupy an area of the outer surface of the copper tube selected from the group consisting of 65% to 95% and 70% to 80%.

4. Mold according to claim 1, wherein the copper tube has a residual wall thickness of 4 mm to 10 mm where the cooling ducts are located.

5. Mold according to claim 1, wherein the cooling ducts are milled into the copper tube and are closed off with a copper layer produced by electrodeposition.

6. Mold according to claim 1, wherein the supporting shell consists of a material selected from the group consisting of a metallic material, austenitic steel, and non-metallic material which can be easily penetrated by magnetic fields.

7. Mold according to claim 1, further comprising externally-arranged magnetic devices selected from the group consisting of electromagnetic coils and moving permanent magnets.

8. Mold according to claim 1, further comprising a protective layer to prevent electrolytic corrosion arranged between the supporting shell and the copper tube.

9. Mold according to claim 1, further comprising cooling-water supply lines and discharge lines arranged at an upper end of the mold that can be connected to cooling-water by a coupling plate.

10. Mold according to claim 1, wherein the securing devices are selected from the group consisting of a dovetail profile, a T-profile for sliding blocks and a clamping device.

11. Mold according to claim 1, wherein the securing devices permit longitudinal movements of the copper tube.

12. Mold for the continuous casting of polygonal billet and bloom formats, comprising a copper tube, which forms a mold cavity, and an arrangement for cooling the copper tube by water-circulation cooling, wherein the copper tube is provided at the tube outer lateral surface, substantially over the entire circumference and substantially over the entire length, with supporting plates which are connected to the copper tube and which support the walls of the copper tube at supporting surfaces thereof, the supporting surfaces comprising at least supporting ribs and connecting ribs provided with securing devices to prevent transverse movements of the copper tube, and further comprising cooling ducts delimited by the supporting ribs and the connecting ribs arranged for guiding the water distributed over the entire circumference and substantially over the entire mold length in one of the copper tube and the supporting plates, wherein said supporting shell comprises grooves for receiving said connecting ribs.

13. Mold according to claim 12, wherein in the case of the mold is rectangular and four supporting plates are releasably attached to the copper tube, each supporting plate butting at an end face against an adjacent plate and overlapping another adjacent plate.

14. Mold according to claim 12, wherein supporting plates adjacent to each other are screwed together in corner regions of the copper tube and form a supporting box arranged around the copper tube.

15. Mold according to claim 12, further comprising elastic seals which allow expansions of the copper tube walls arranged in overlap gaps between the supporting plates.

16. Mold according to claim 12, further comprising narrow supporting surfaces arranged along corner regions thereof and wherein at least one of the supporting ribs or the connecting ribs are arranged in a middle region of the mold sides.

17. Mold according to claim 12, wherein the securing devices are selected from the group consisting of a dovetail profile, a T-profile for sliding blocks and a clamping device.

18. Mold according to claim 12, wherein the copper tube forms a curved mold cavity and has curved supporting surfaces and the supporting plates have surfaces opposite the curved supporting surfaces.

19. Mold according to claim 12, wherein the securing devices permit longitudinal movements of the copper tube.

* * * * *